US012708826B2

(12) United States Patent
Trott

(10) Patent No.: US 12,708,826 B2
(45) Date of Patent: Aug. 18, 2026

(54) GOLF PUTTER FITTING DEVICE AND METHOD OF USE THEREOF

(71) Applicant: Christopher Trott, Carlsbad, CA (US)

(72) Inventor: Christopher Trott, Carlsbad, CA (US)

( * ) Notice: Subject to any disclaimer, the term of this patent is extended or adjusted under 35 U.S.C. 154(b) by 273 days.

(21) Appl. No.: 18/243,432

(22) Filed: Sep. 7, 2023

(65) Prior Publication Data

US 2025/0083008 A1 Mar. 13, 2025

(51) Int. Cl.
*A63B 69/36* (2006.01)
*A63B 60/42* (2015.01)

(52) U.S. Cl.
CPC ..... *A63B 60/42* (2015.10)

(58) Field of Classification Search
CPC ..... A63B 60/42; A63B 69/3682; A63B 2071/0694; A63B 2209/08
USPC ..... 473/150, 157, 159, 160, 171, 218, 252, 473/278, 279, 409
See application file for complete search history.

(56) References Cited

U.S. PATENT DOCUMENTS 3,471,155 A * 10/1969 Donaldson ..... A63B 69/36211 473/260
5,332,211 A * 7/1994 Rife ..... A63B 69/3676 473/258
5,630,719 A * 5/1997 Franklin ..... A63B 67/02 473/157
7,214,146 B1 * 5/2007 Gersang ..... A63B 69/3667 473/409
9,550,104 B2 * 1/2017 Taft ..... A63B 69/3623
2020/0129833 A1 * 4/2020 Cooper ..... A63B 69/3676
2020/0391093 A1 * 12/2020 Gribovsky ..... A63B 69/3661

* cited by examiner

*Primary Examiner* — Nini F Legesse

(57) ABSTRACT

The present disclosure relates to a golf putter fitting device and method of use thereof. Particularly, the golf putter fitting device includes a thin pad having a mirrored surface disposed on a top side portion of the thin pad and two slots disposed along a lengthwise section of the thin pad, a sliding bar disposed on the mirrored surface and coupled to the two slots, and a plurality of reference markers disposed on the mirrored surface for determining a putter selection zone from a plurality of putter zones.

20 Claims, 14 Drawing Sheets

Zone 1

Zone 2

Zone 3

200

| Zone | Putter Type |
|---|---|
| 1A | Face Balanced (0 Degrees) |
| 1B | Toe Hang - 2 Degrees |
| 1C | Toe Hang - 4 Degrees |
| 1D | Toe Hang - 6 Degrees |
| 1E | Toe Hang - 8 Degrees |
| 1F | Toe Hang - 10 Degrees |
| 1G | Toe Hang - 12 Degrees |
| 1H | Toe Hang - 14 Degrees |
| 1I | Toe Hang - 16 Degrees |
| 2A | Toe Hang - 18 Degrees |
| 2B | Toe Hang - 21 Degrees |
| 2C | Toe Hang - 24 Degrees |
| 2D | Toe Hang - 27 Degrees |
| 2E | Toe Hang - 30 Degrees |
| 2F | Toe Hang - 33 Degrees |
| 2G | Toe Hang - 36 Degrees |
| 2H | Toe Hang - 39 Degrees |
| 2I | Toe Hang - 42 Degrees |
| 3A | Toe Hang - 45 Degrees |
| 3B | Toe Hang - 50 Degrees |
| 3C | Toe Hang - 55 Degrees |
| 3D | Toe Hang - 60 Degrees |
| 3E | Toe Hang - 65 Degrees |
| 3F | Toe Hang - 70 Degrees |
| 3G | Toe Hang - 75 Degrees |
| 3H | Toe Hang - 80 Degrees |
| 3I | Toe Hang - 85-90 Degrees |

FIG. 11

GOLF PUTTER FITTING DEVICE AND METHOD OF USE THEREOF

FIELD OF THE DISCLOSURE

The present disclosure relates to a golf putter fitting device and method of use thereof. Particularly, the golf putter fitting device provides a golfer a method of measuring and determining and fitting a golf putter type that is suitable for the golfer based upon visual factors and a dominant eye alignment of the golfer when viewing reference markers on the golf putter fitting device at an address position.

BACKGROUND

Putter selection can be difficult, time-consuming, and can be costly considering that the cost of a single putter can be in the hundreds of dollars for each putter. Since no two people have the exact same golf swing, methods for determining the best putter for a particular golfer are generally based on the golfer's putting style in view of their putting stroke, the type of putter head selected, and the putter shaft size. These methods are often subjective, unreliable, and time consuming in order to find a suitable putter that best matches the golfer.

Currently, there are no golf training devices that provide a golfer a means by which they can quickly, efficiently, and accurately determine a putter type that is suitable to a particular golfer based upon visual factors associated with the golfer. Therefore, it would be highly desirable to have a reliable, accurate, and easy to use putter measuring device for quickly determining and fitting a type of putter to a golfer based on visual factors for use in the golfing industry.

SUMMARY

It is an advantage of the present disclosure to provide a golf putter fitting device for selecting a golf putter type for a golfer including a thin pad having a mirrored surface disposed on a top side portion of the thin pad and two slots disposed along a lengthwise section of the thin pad, a sliding bar disposed on the mirrored surface and slidably coupled to the two slots, and a plurality of reference markers disposed on the mirrored surface for determining a putter selection zone from a plurality of putter zones by sliding the sliding bar to a reference point disposed on the mirrored surface corresponding to a visual alignment of a reflection of a dominant eye of the golfer to the reference point when the golf putter fitting device is placed on a ground surface with the mirrored surface facing the golfer at an address position and directly viewed from above by the golfer and a face portion of the golfer is reflected on the mirrored surface, such that the golf putter type is selected based upon the putter selection zone and the dominant eye of the golfer.

It is another advantage of the present disclosure to a method of selecting a putter type for a golfer from a golf putter fitting device having a thin pad, a mirrored surface disposed on a top side portion of the thin pad, two slots disposed along a lengthwise section of the thin pad, a sliding bar disposed on the mirrored surface and slidably coupled to the two slots, and a plurality of reference markers disposed on the mirrored surface, the method including placing the golf putter fitting device in front of the feet of the golfer with the mirrored surface facing up, where a reflection of a dominant eye of the golfer appears on the mirrored surface and visible to the golfer at an address position; positioning the sliding bar to a reference point disposed on the mirrored surface corresponding to a visual alignment of the reflection of the dominant eye of the golfer to the reference point; determining a putter selection zone from a plurality of putter zones based on a position of the sliding bar to the reference point; and selecting a putter type based upon the putter selection zone.

In one aspect, a ball slot is disposed along an edge portion of the thin pad. In another aspect, the plurality of reference markers a horizontal target line centrally disposed along the lengthwise section of the thin pad, two vertical putter lines disposed proximate to the golf ball slot, a first array of dots disposed on one side of the horizontal putter line, a second array of dots matching the first array of dots, wherein the horizontal target line separates the first array of dots from the second array of dots, a first horizontal row of dots adjacent to the first array of dots, and a second horizontal row of dots adjacent to the second array of dots. In yet another aspect, the first array of dots, second array of dots, first horizontal row of dots, and second horizontal row of dots are separated into groups of three equally divided columns representing the plurality of putter zones.

In one embodiment, a slip resistance surface is applied to a bottom side of the thin pad. In another embodiment, the dominant eye of the golfer is a left eye or a right eye of the golfer. In yet another embodiment, the golf putter type includes a face balanced putter, a slight toe hang putter, moderate toe hang putter, or a high toe hang putter.

These and other objects, features and advantages of the present disclosure will become more apparent in light of the following detailed description of preferred embodiments thereof, as illustrated in the accompanying drawings.

BRIEF DESCRIPTION OF THE DRAWINGS

The present disclosure will be more clearly understood from the following detailed description of the preferred embodiments of the disclosure and from the attached drawings, in which:

FIG. 11 illustrates a putter selection table fitting a putter type with a putter selection zone determined from the golf putter fitting device, in accordance to an embodiment.

In the appended figures, one or more elements may have the same reference numeral in different figures indicating previously described.

DETAILED DESCRIPTION

Figure 1:
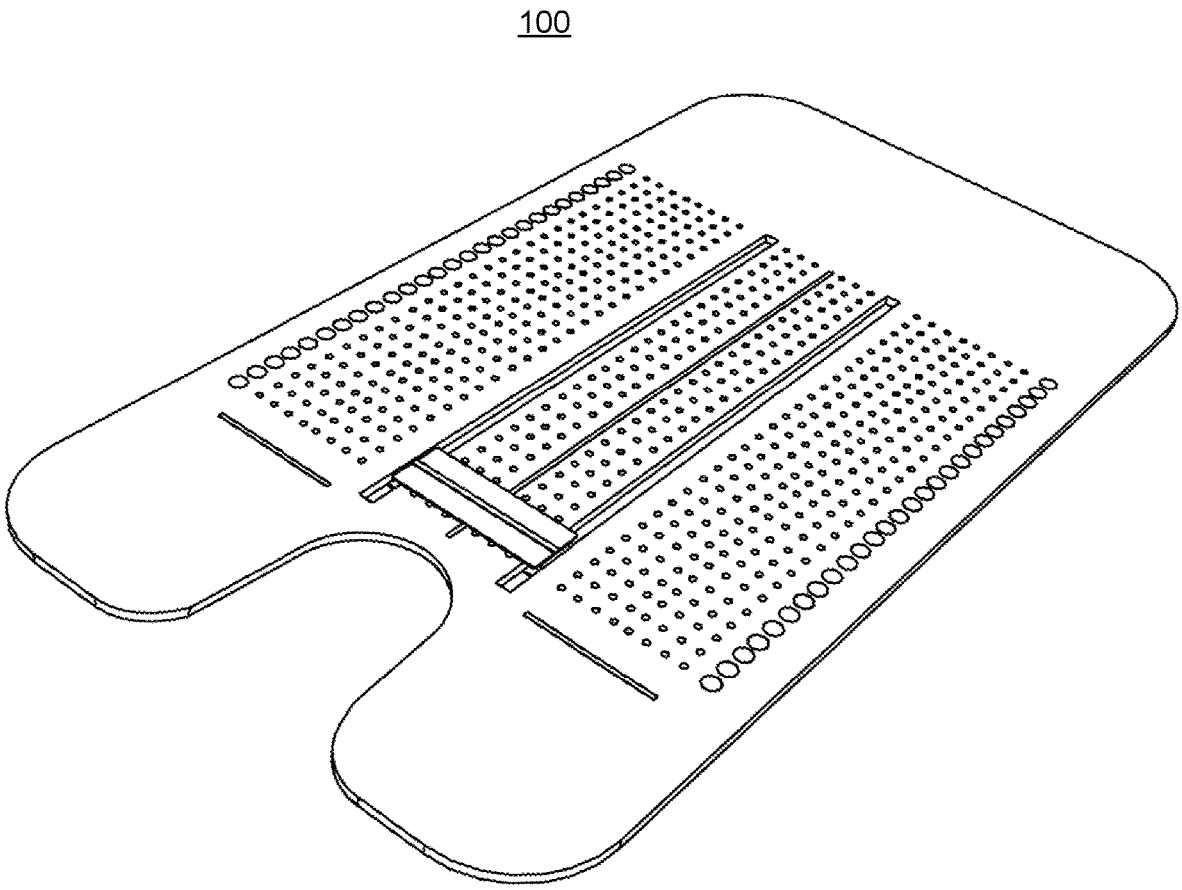
FIG. 1 illustrates a golf putter fitting device, in accordance to an embodiment.

FIG. 1 illustrates a golf putter fitting device 100, in accordance to an embodiment. The concept of golf putter fitting device 100 is akin to a foot-measuring device which is generally available in almost all retail footwear stores. The basic premise and use of such devices is to quickly and easily match the user to a particular product type, style, or size before selecting or trying them in-store. For example, a person interested in shoes can use foot-measuring device in order to determine their foot size as indicated by a shoe number size on the foot-measuring device. Once the shoe number size is known, the person may narrow their selection of shoes that best matches their shoe number size. Similarly, the golf putter fitting device provides the golfer a way of measuring and determining a type of golf putter that is suitable to the golfer based upon visual factors and eye alignment of the golfer when viewing the golf putter fitting device 100 at an address position.

Figure 2B:
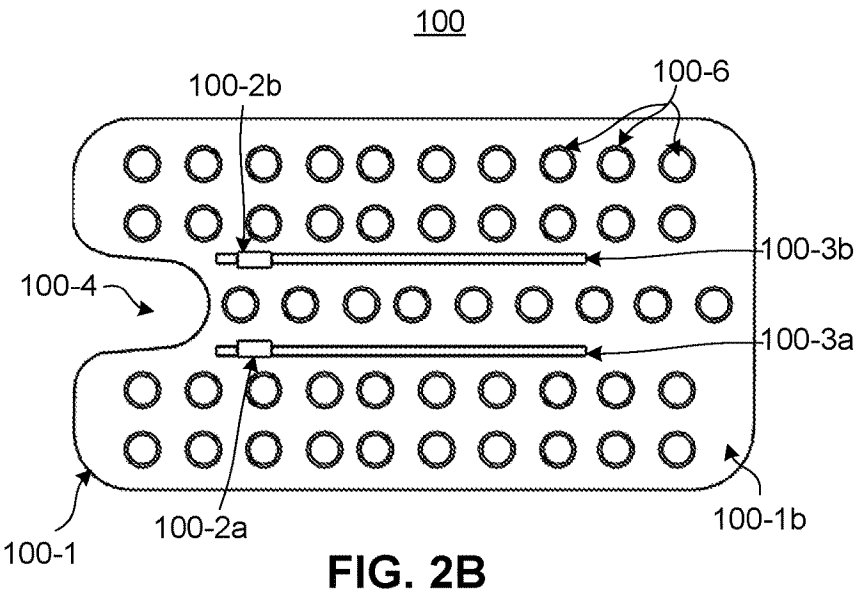
FIG. 2A-FIG. 2D illustrate a top view, a backside view, a side, and perspective view, respectively, of the golf putter fitting device, in accordance to an embodiment.
Figure 2D:
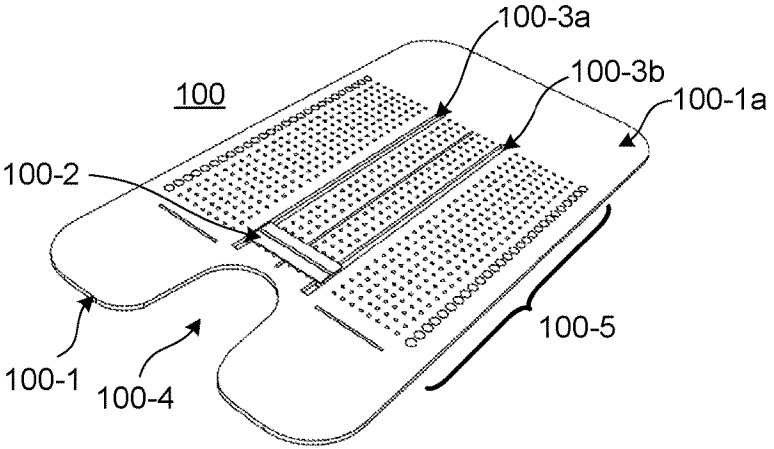
Figure 2A:
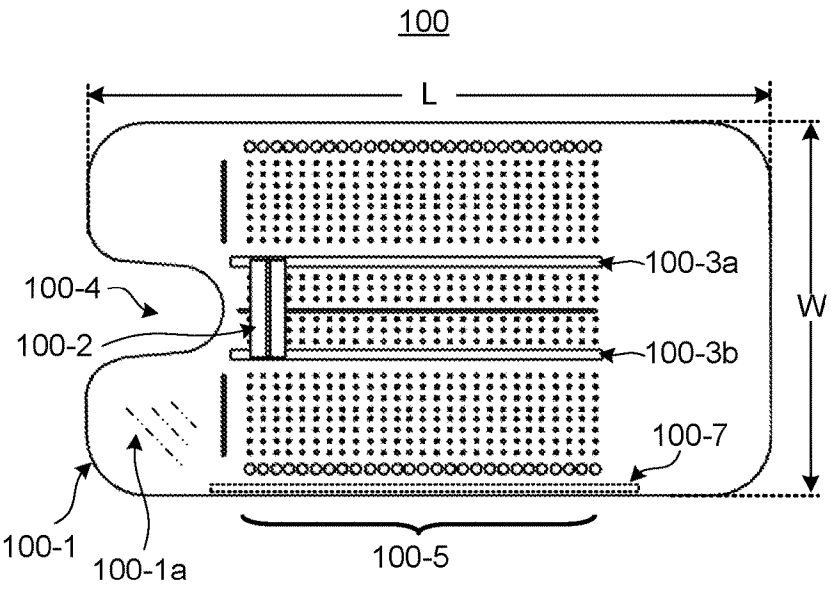
Figure 2C:
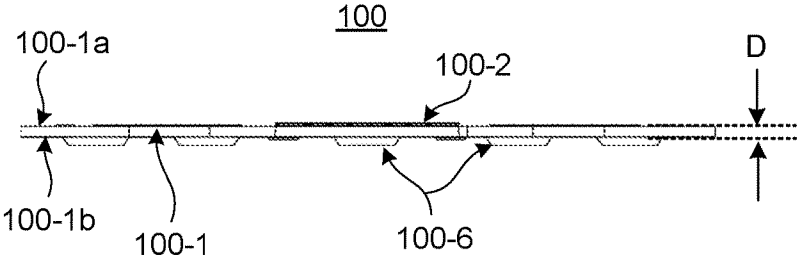

FIG. 2A-FIG. 2D illustrate a top view, a backside view, a side, and perspective view, respectively, of the golf putter fitting device 100, in accordance to an embodiment. FIG. 2A (top view) illustrates the golf putter fitting device 100 is a thin pad 100-1 having a mirrored surface 100-1*a* disposed on the top portion of the thin pad 100-1, two slots (100-2*a*, 100-2*b*) disposed along a lengthwise section of the thin pad 100-1, a sliding bar 100-2 coupled to the two slots (100-3*a*, 100-3*b*) via sliding bar connecting components (100-2*a*, 100-2*b*), a golf ball slot 100-4 disposed on one end portion of the thin pad 100-1, and a plurality of reference markers 100-5 applied to the mirrored surface 100-1*a*. In one non-limiting implementation, the thin pad 100-1 is generally rectangular in shape having rounded corners and approximately 10 to 12 inches length (L), 5 to 7 inches width (W), and 0.125 to 0.50 in thickness (D). The thin pad 100-1 itself may be made from lightweight and impact resistant materials such as acrylonitrile butadiene styrene (ABS), High-density polyethylene (HDPE), Polycarbonate (PC), allowing it withstand breakage, warping, or bending when in use. The mirrored surface 100-1*a* can be a reflective layer like metal like silver, tin, nickel, or chromium, or aluminum which is deposited onto the surface of the thin pad 100-1. In some applications, the mirrored surface 100-1*a* may include a plastic mirror made from acrylic, polycarbonate, or PETG. FIG. 2B illustrates a bottom side 100-1*b* of the golf putter fitting device 100 having a slip resistance surface 100-6 applied to the bottom side of the thin pad 100-1. In one aspect, the slip resistance surface 100-6 may include a level surface having multiple protuberances (i.e., bumps) formed on the level surface which prevents the golf putter fitting device 100 from shifting when placed on the synthetic or natural grass playing field. In another aspect, the slip resistance surface 100-6 may include materials having a rough or patterned surface made from natural or synthetic rubber. In yet another embodiment, a magnetic member 100-7 may be embedded or coupled along an edge portion of the thin pad 100-1, allowing the pad to magnetically couple to other optional pads.

Figure 3:
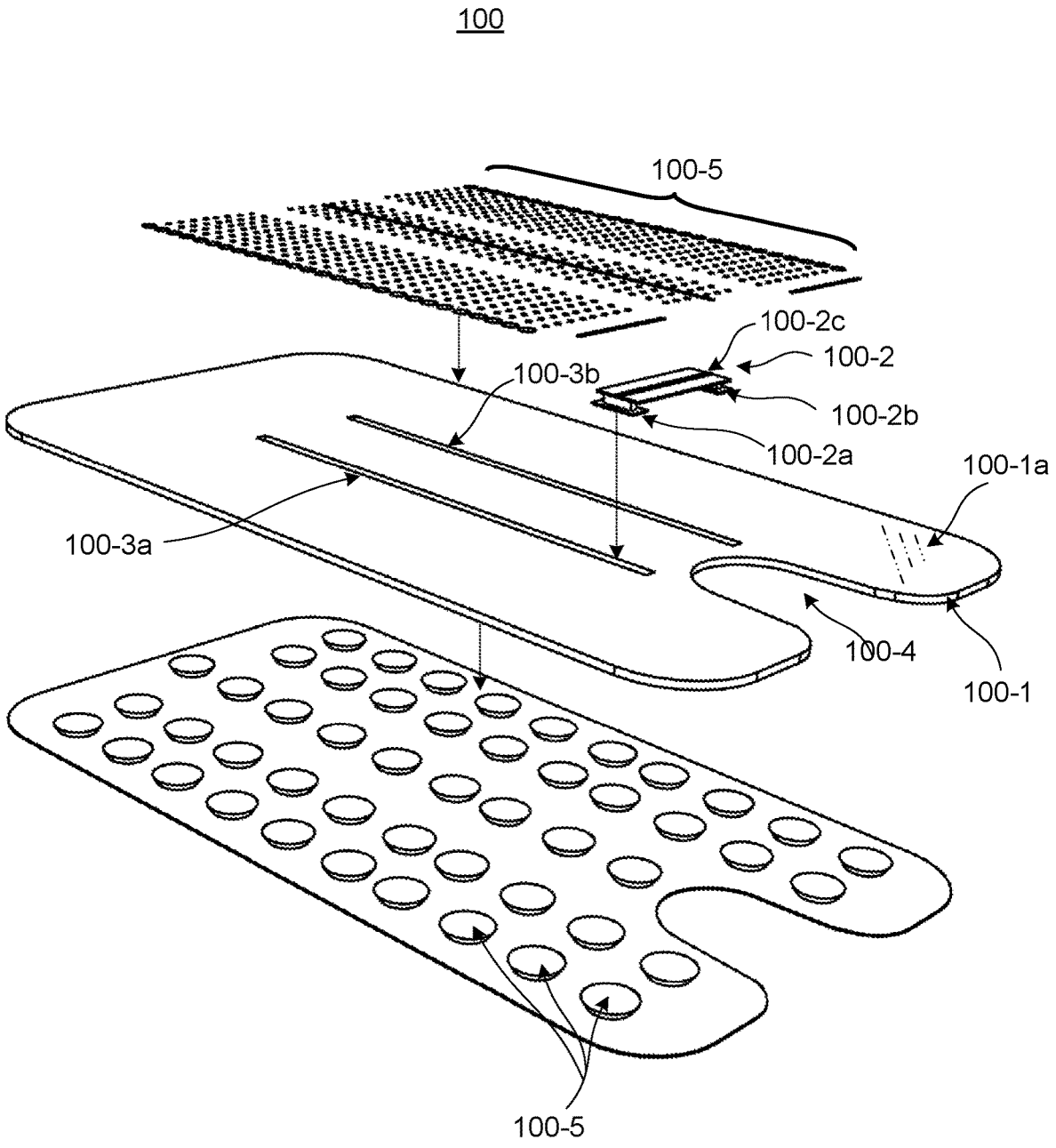
FIG. 3 illustrates an exploded view of the golf putter fitting device, in accordance to an embodiment.

FIG. 3 illustrates an exploded view of the golf putter fitting device 100, in accordance to an embodiment. In one aspect, the plurality of reference markers 100-5 may be printed directly on the mirrored surface 100-1*a* via ink or spray printing techniques. In another aspect, the plurality of reference markers 100-5 may be printed on a transparent adhesive film which is attached onto the mirrored surface 100-1*a* along the adhesive side of the transparent adhesive film. In another aspect, the sliding bar 100-2 may also include an eye alignment guide 100-2*c* centrally disposed along a lengthwise portion of the sliding bar 100-2. In yet another aspect, the sliding bar connecting components (100-2*a*, 100-2*b*) of the sliding bar 100-2 are inserted, but not fastened, into the two slots (100-3*a*, 100-3*b*) of the thin pad 100-1, allowing the sliding bar 100-2 to freely move in horizontal direction along the two slots (100-3*a*, 100-3*b*). The golf putter fitting device 100 may also include reference holes 100-5*m* for receiving tee pegs.

Figure 4:
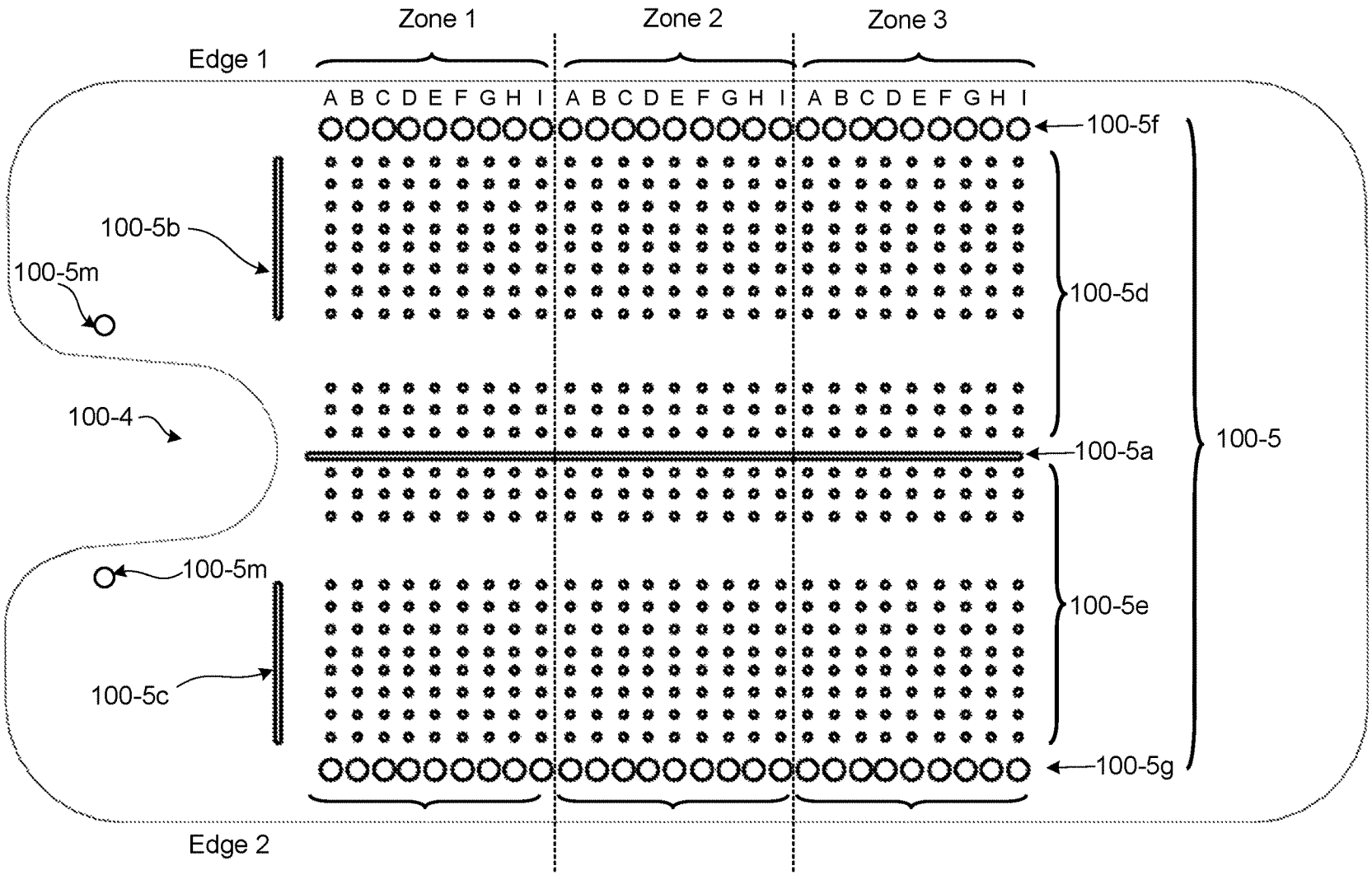
FIG. 4 illustrates additional features of the plurality of reference markers, in accordance to an embodiment.

FIG. 4 illustrates additional features of the plurality of reference markers 100-5, in accordance to an embodiment. The plurality of reference markers 100-5 include a horizontal target line 100-5*a* centrally disposed along a lengthwise portion of the thin pad 100-1, two vertical putter lines (100-5*b*, 100-*c*) disposed proximate to the golf ball slot 100-4, a first array of dots 100-5*d* disposed on one side of the horizontal putter line 100-5*a*, a second array of dots 100-5*e* matching the first array of dots 100-5*d* where the horizontal target line 100-5*a* separates the first array of dots 100-5*d* from the second array of dots 100-5*e*, a first horizontal row of dots 100-5*f* adjacent to the first array of dots 100-5*d*, and a second horizontal row of dots 100-5*g* adjacent to the second array of dots 100-5*e*. Three groups of columns including the first and second array of dots (100-5*d*, 100-5*e*) and first and second horizontal row of dots (100-5*f*, 100-5*g*) may be separated into three putter selection zones (Zone 1, Zone 2, and Zone 3) for determining and selecting a putter type that is suitable for a golfer as later described in this document. In one implementation, Zone 1 may include a first group of nine columns (A-I) of dots extending from a first edge portion (Edge 1) to a second edge portion (Edge 2) proximate to the golf ball slot 100-4, Zone 2 may include a second group nine columns (A-I) of dots adjacent to the first group of nine columns extending from a first edge portion (Edge 1) to a second edge portion (Edge 2), and Zone 3 may include a third group of nine columns (A-I) of dots adjacent to the second group of nine columns extending from a first edge portion (Edge 1) to a second edge portion (Edge 2). In another implementation, the first and second horizontal row of dots (100-5*f*, 100-5*g*) may be color coded in groups of nine dots indicating each zone. For example, the first group of nine dots in the horizontal row of dots (100-5*f*, 100-5*g*) may be color coded as red to indicate Zone 1, the second group of nine dots in the horizontal row of dots (100-5*f*, 100-5*g*) may be color coded as blue to indicate Zone 2, and the third group of nine dots in the horizontal row of dots (100-5*f*, 100-5*g*) may be color coded as green to indicate Zone 3. Note, shapes and colors of the reference markers described herein are provided as examples and are not limited to dots or color samples presented. The reference markers may include but are not limited to a variety of other shapes and patterns (e.g., squares, triangular, dashes, stars, diamonds, etc.) and colors (yellow, purple, black, etc.) including shades of the same color. In practice, the first and second array of dots (100-5*d*, 100-5*e*) represent columns of reference points to which the sliding the sliding bar 100-2 aligns based on a visual reflection of the position of the golfer's dominant eye overlapping a particular reference point.

Figures 5A, 5B, 5C:
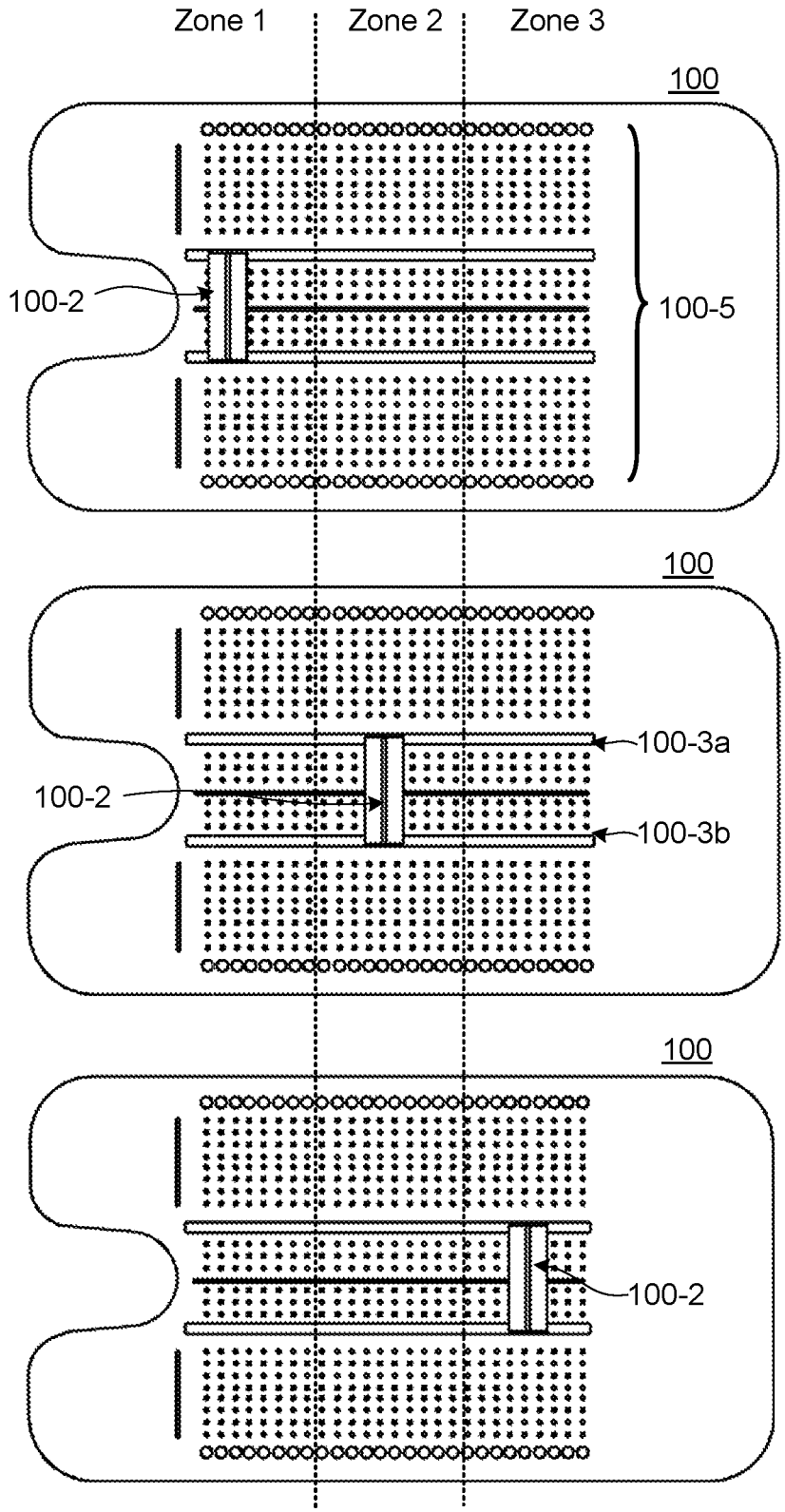
FIG. 5A-FIG. 5C illustrate sliding positions of the sliding bar along the two slots of the golf putter fitting device, in accordance to an embodiment.

FIG. 5A-FIG. 5C illustrate sliding positions of the sliding bar 100-2 along the two slots (100-3*a*, 100-3*b*) of the golf putter fitting device 100, in accordance to an embodiment. In FIG. 5A, the sliding bar 100-2 is shown to be positioned in Zone 1 which is proximate to the golf ball slot 100-4. In FIG. 5B, the sliding bar 100-2 is shown to be positioned in Zone 2 which is near the middle of the thin pad 100-1. In FIG. 5C, the sliding bar 100-2 is shown to be positioned in Zone 3 which is proximate to a closed end portion of the thin pad 100-1. In practice, the sliding bar 100-2 is horizontally adjustable in order to set the sliding bar 100-2 to a putter selection zone for determining and selecting a putter type that is suitable for a golfer.

Figure 6A:
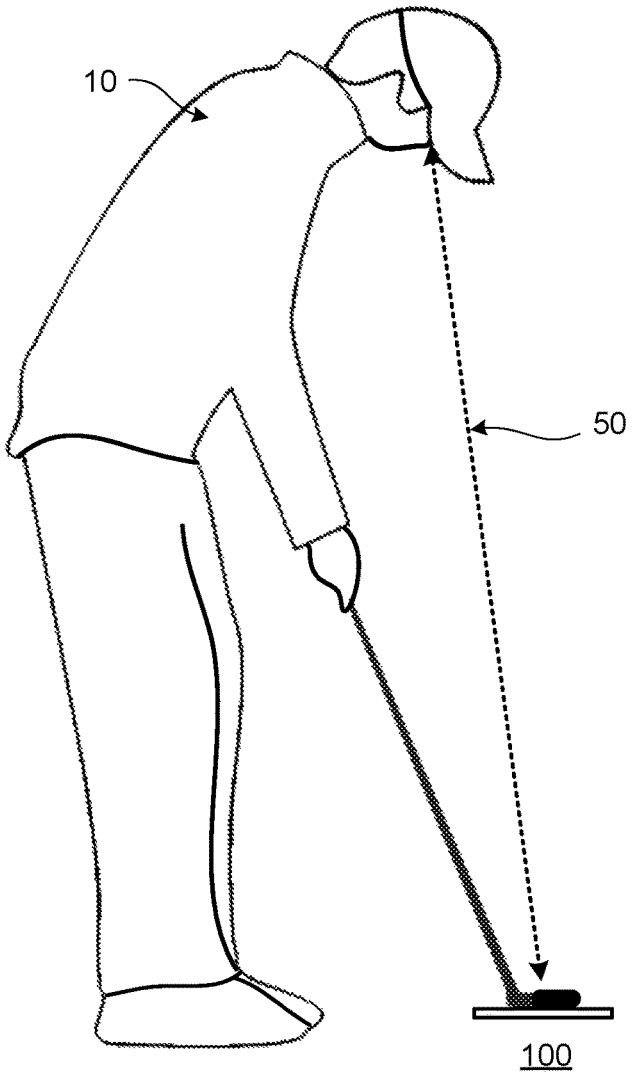
FIG. 6A-FIG. 6B illustrate an initial setup and use of the golf putter fitting device by a golfer at address position, in accordance to an embodiment.
Figure 6B:
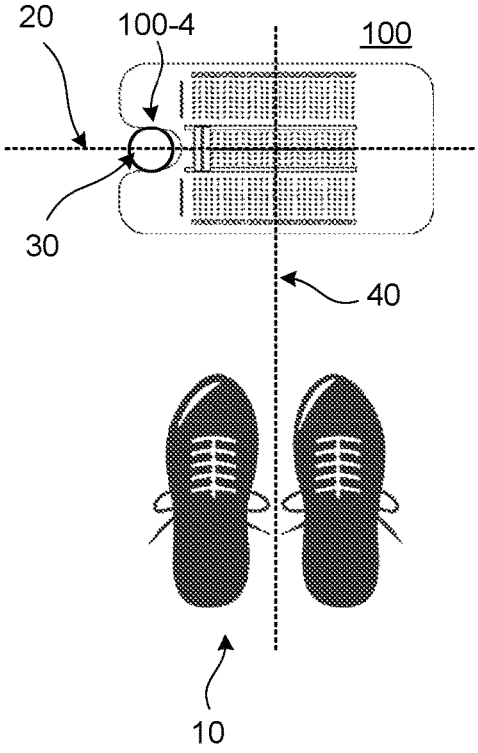

FIG. 6A-FIG. 6B illustrate an initial setup and use of the golf putter fitting device 100 by a golfer 10 at address position, in accordance to an embodiment. To setup the golf putter fitting device 100, the golf putter fitting device 100 is placed on a ground surface in front of the feet of the golfer 10 with the mirrored surface 100-1*a* side facing up so that the horizontal target line 100-5*a* of the golf putter fitting device 100 is coincident to a target line 20 on the ground surface. A golf ball 30 can be place at the golf ball slot 100-4 as a reference to adjust the golfer's stance at address position. The feet of the golfer 10 is positioned between a mid-section 40 of the golf putter fitting device 100. With the golf putter fitting device 100 on the target line 20 and the golfer 10 at address position gazing down at their reflection 50 as it appears on the golf putter fitting device 100, the device 100 is setup and now ready for use to determine a putter selection zone based on the golfer's visual feedback as described in the following section.

Figure 7A:
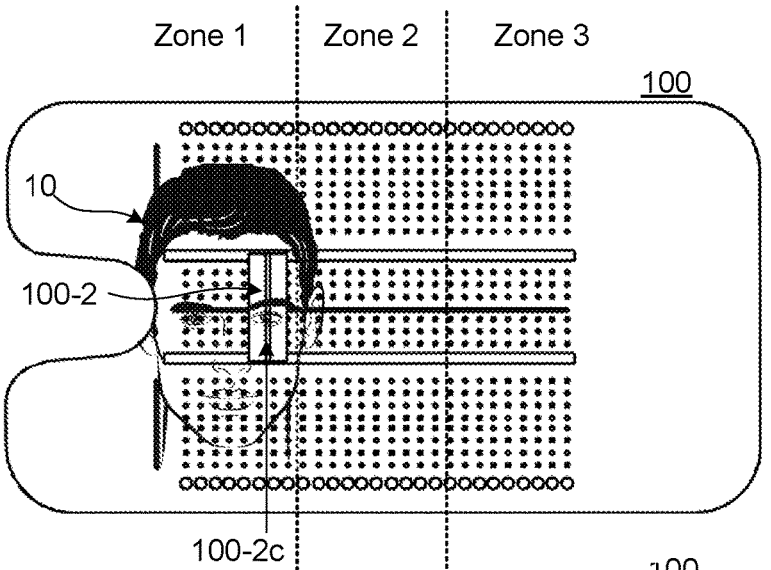
FIG. 7A-FIG. 7C illustrate a method of determining a zone for a golfer having a dominant right-eye while using the golf putter fitting device, in accordance to an embodiment.
Figure 7B:
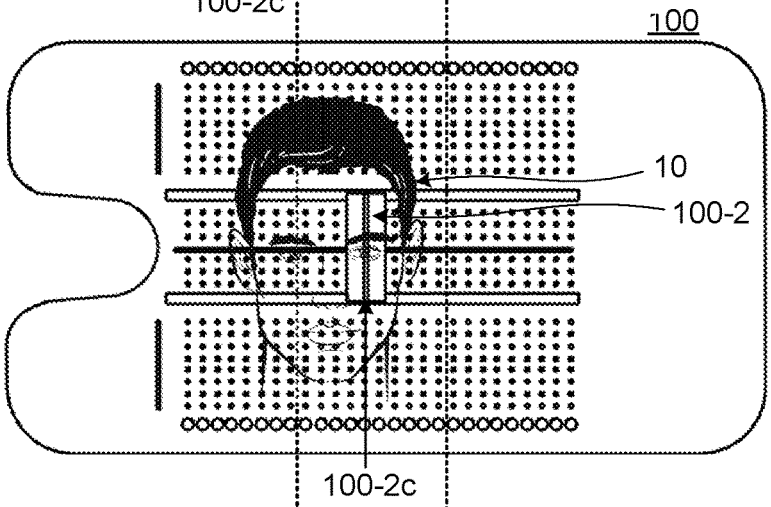
Figure 7C:
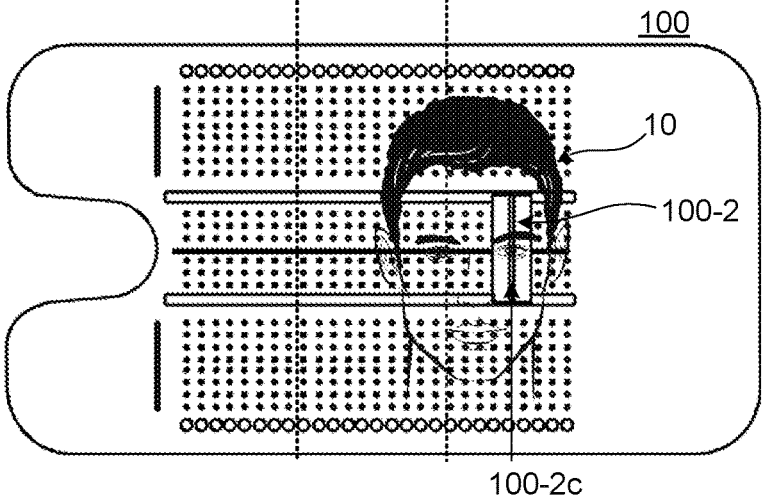

FIG. 7A-FIG. 7C illustrate a method of determining a zone for a golfer 10 having a dominant right-eye while using the golf putter fitting device 100, in accordance to an embodiment. With the golf putter fitting device 100 setup at address position and the golfer 10 gazing directly down at the golf putter fitting device 100, a reflection of the golfer's face is clearly visible and seen by the golfer 10 on the mirrored surface 100-1*a* of the golf putter fitting device 100. In FIG. 7A, the golfer 10 who is right-eye dominant sees the reflection of their right eye on the mirrored surface 100-1*a* appear in Zone 1 of the golf putter fitting device 100. The sliding bar 100-2 is then moved so that the eye alignment guide 100-2*c* aligns to the right eye of the golfer 10, verifying the precise position of the right eye at Zone 1 as it appears in the golf putter fitting device 100. In FIG. 7B, the golfer 10 who is right-eye dominant sees the reflection of their right eye on the mirrored surface 100-1*a* appear in Zone 2 of the golf putter fitting device 100. The sliding bar 100-2 is then moved so that the eye alignment guide 100-2*c* aligns to the right eye of the golfer 10, verifying the precise position of the right eye at Zone 2 as it appears in the golf putter fitting device 100. In FIG. 7C, the golfer 10 who is right-eye dominant sees the reflection of their right eye on the mirrored surface 100-1*a* appear in Zone 3 of the golf putter fitting device 100. The sliding bar 100-2 is then moved so that the eye alignment guide 100-2*c* aligns to the right eye of the golfer 10, verifying the precise position of the right eye at Zone 3 as it appears in the golf putter fitting device 100. In addition, the precise position in each zone can include the exact column number value based on the exact positioning of the eye alignment guide 100-2*c* overlapping a reference point of a certain column. For example, if the eye alignment guide 100-2*c* is in Zone 1 and aligns or overlaps to a reference point in column F of Zone 1, then the precise zone would be assigned a value of Zone 1F as shown in FIG. 7A.

Figure 8A:
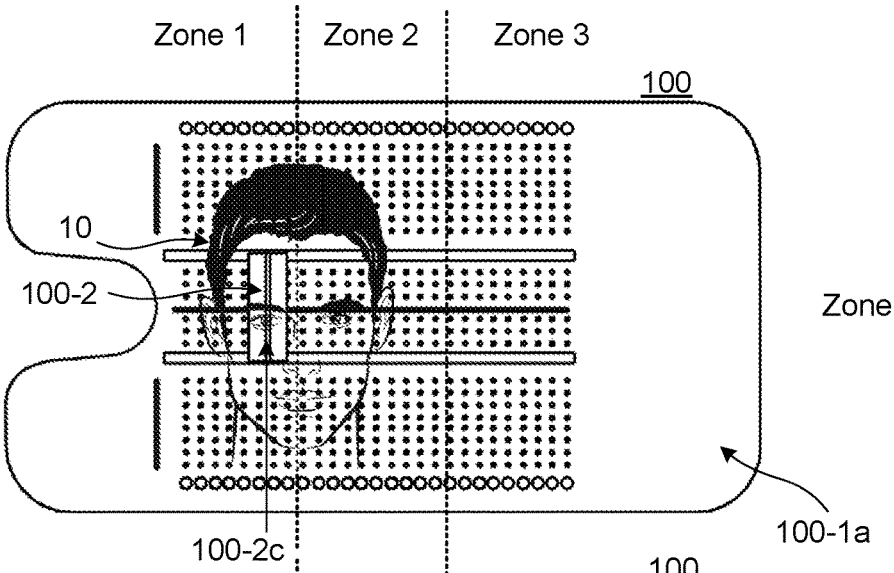
FIG. 8A-FIG. 8C illustrate a method of determining a zone for a golfer 10 having a dominant left-eye while using the golf putter fitting device, in accordance to an embodiment.
Figure 8B:
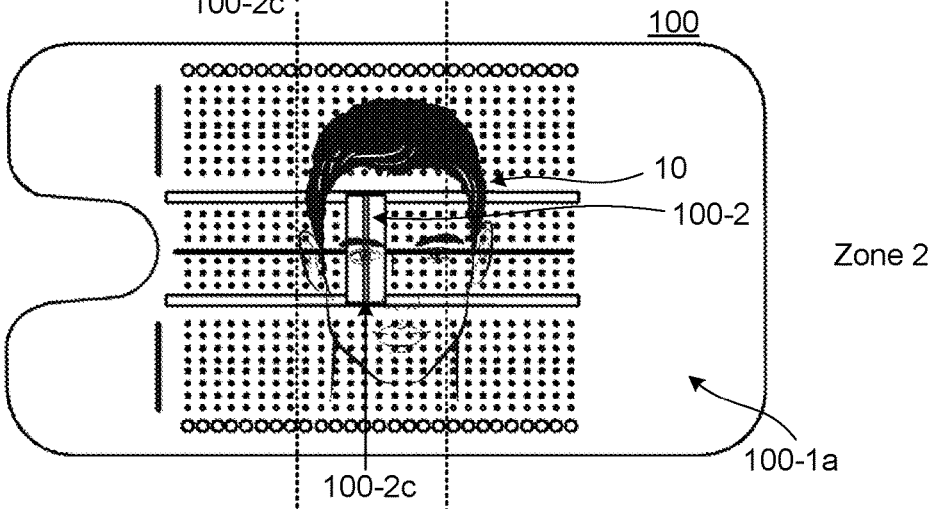
Figure 8C:
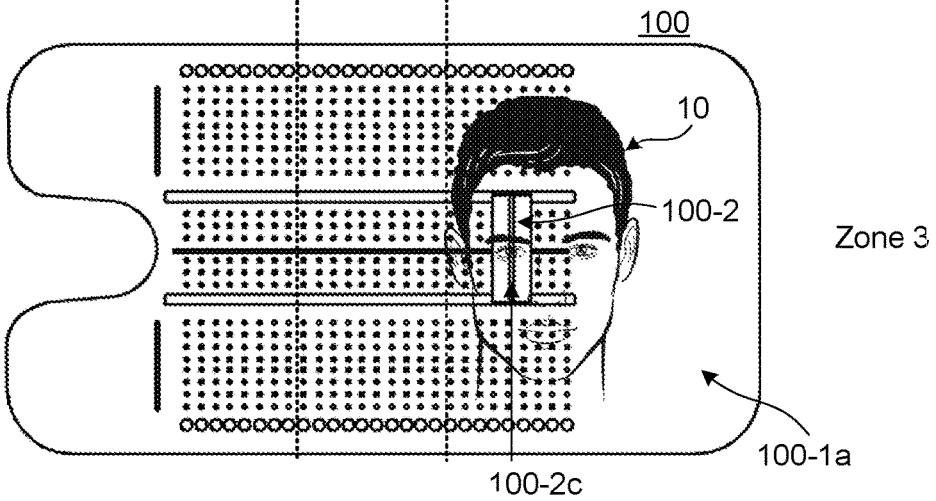

FIG. 8A-FIG. 8C illustrate a method of determining a zone for a golfer 10 having a dominant left-eye while using the golf putter fitting device 100, in accordance to an embodiment. As in the previous embodiment, the golf putter fitting device 100 is setup at address position with the golfer 10 gazing directly down at the golf putter fitting device 100. The reflection of the golfer's face is clearly visible and seen by the golfer 10 on the mirrored surface 100-1*a* of the golf putter fitting device 100. In FIG. 8A, the golfer 10 who is left-eye dominant sees the reflection of their left eye on the mirrored surface 100-1*a* appear in Zone 1 of the golf putter fitting device 100. The sliding bar 100-2 is then moved so that the eye alignment guide 100-2*c* aligns to the left eye of the golfer 10, verifying the exact position of the left eye at Zone 1 as it appears in the golf putter fitting device 100. In FIG. 8B, the golfer 10 who is left-eye dominant sees the reflection of their left eye on the mirrored surface 100-1*a* appear in Zone 2 of the golf putter fitting device 100. The sliding bar 100-2 is then moved by sliding it horizontally so that the eye alignment guide 100-2*c* aligns to the left eye of the golfer 10, verifying the exact position of the left eye at Zone 2 as it appears in the golf putter fitting device 100. In FIG. 8C, the golfer 10 who is left-eye dominant sees the reflection of their left eye on the mirrored surface 100-1*a* appear in Zone 3 of the golf putter fitting device 100. The sliding bar 100-2 is then horizontally moved so that the eye alignment guide 100-2*c* aligns to the left eye of the golfer 10, verifying the exact position of the left eye at Zone 3 as it appears in the golf putter fitting device 100. In addition, the precise position in each zone can include the exact column number value based on the exact positioning of the eye alignment guide 100-2*c* overlapping a reference point of a certain column. For example, if the eye alignment guide 100-2*c* is in Zone 2 and aligns and overlaps to a reference point in column E of Zone 2, then the precise zone would be assigned a value of Zone 2E as shown in FIG. 8B.

Figure 9A:
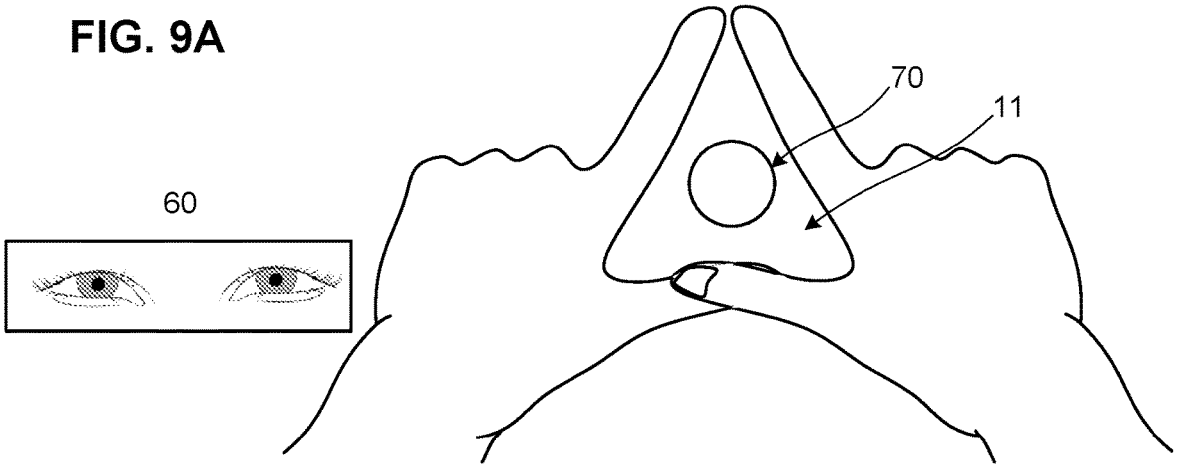
FIG. 9A-FIG. 9C illustrate a simple method of determining a dominant eye of a person.
Figure 9B:
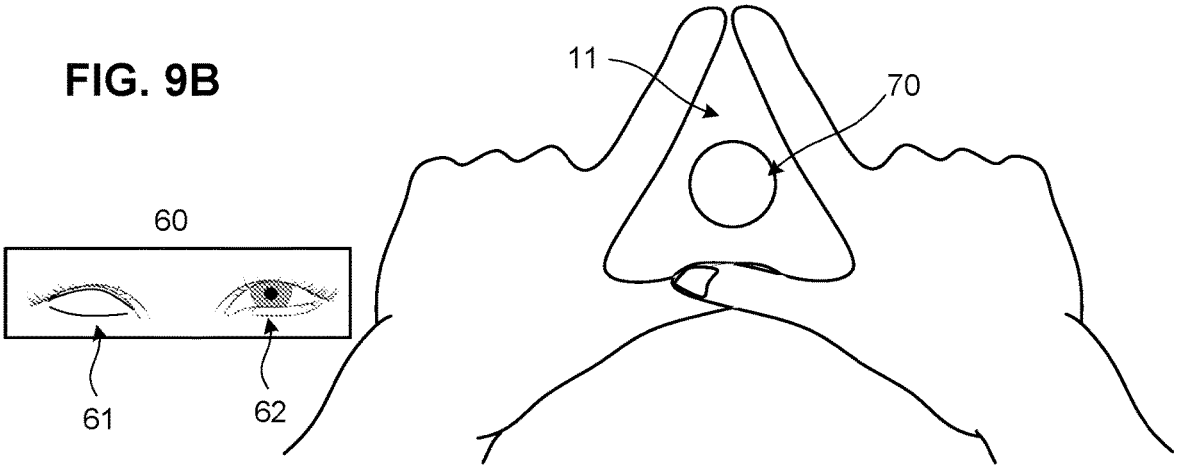
Figure 9C:
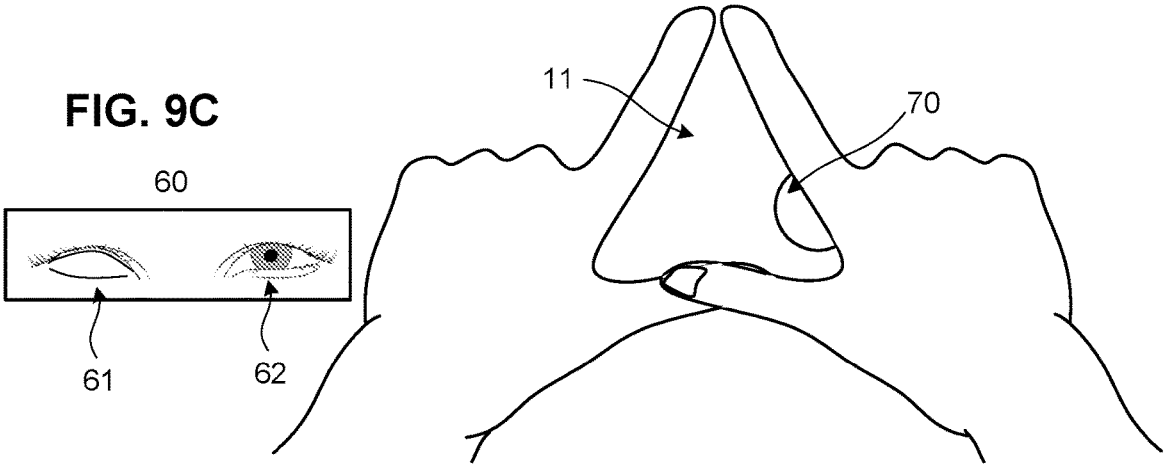

In golfing, proper alignment of putting generally require adequate head movements and use your dominant eye to accurately position your body and club head. Prior to using the golf putter fitting device 100 for fitting purposes, it is important that the dominant eye of the golfer is known in order to precisely fit a putter type with the golfer. FIG. 9A-FIG. 9C illustrate a simple method of determining a dominant eye of a person. Extend your arms out in front of you and form a triangular opening 11 between your forefingers and thumbs by placing your hands together at approximately a 45-degree angle (see FIGS. 9A-9C). With both eyes open 60, center the triangular opening on a nearby object 70 such as a clock, small appliance, or picture frame as shown in FIG. 9A. With your left eye closed 61, if the object 70 stays centered, your right eye (the open eye 62) is your dominant eye as shown in FIG. 9B. If the object 60 is no longer framed by your hands, your left eye 61 is your dominant eye as shown in FIG. 9C.

Figure 10A:
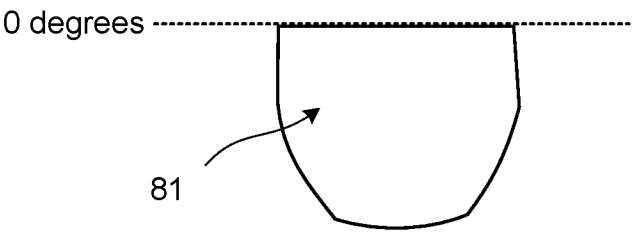
FIG. 10A-FIG. 10D illustrate a golf club putter types having various toe hang, in accordance to an embodiment.
Figure 10B:
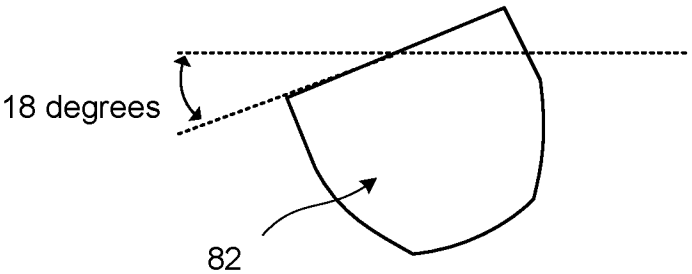
Figure 10C:
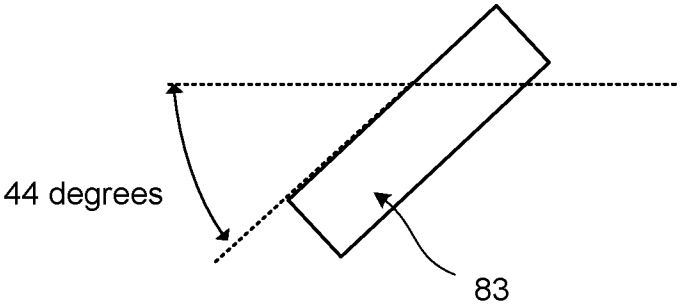
Figure 10D:
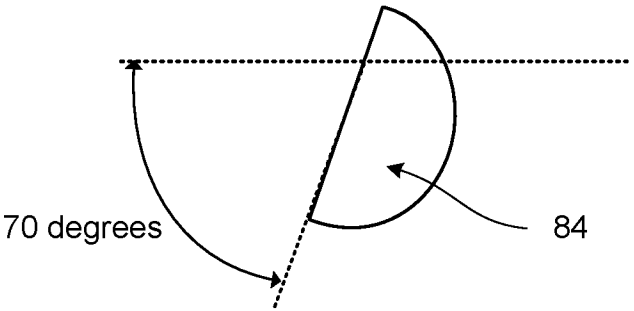

A toe hang putter is generally designed to assist the golfer with keeping the putter face square at impact which is especially useful if the golfer's stroke has an arc to it. The toe hang putter is generally useful if the golfer putts with a moderate to strong arc while a face balanced putter is preferred if the golfer has a slight arc, or a straight back and through putting technique. FIG. 10A-FIG. 10D illustrate a golf club putter types having various toe hang, in accordance to an embodiment. For example, FIG. 10A illustrates a face balanced putter 81 having 0 degree tilt along the golf shaft's axis. FIG. 10B illustrates a slight toe hang putter 82 having approximately 18 degrees of tilt along the golf shaft's axis. FIG. 10C illustrates a moderate toe hang putter 83 having approximately 44 degrees of tilt along the golf shaft's axis. FIG. 10B illustrates a high toe hang putter 84 having approximately 70 degrees of tilt along the golf shaft's axis.

FIG. 11 illustrates a putter selection table 200 fitting a putter type with a putter selection zone determined from the golf putter fitting device 100, in accordance to an embodiment. Based on table 200, a preferred putter type can be quickly assessed and identified by the golfer 10 based on their putter selection zone as determined from the golf putter fitting device 100. For example, if the golfer 10 has determined that their putter selection zone from the golf putter fitting device 100 is 1H, then the appropriate or recommended putter type for this zone and golfer 10 would be a \ Toe Hang of 14 degrees as indicated in table 200. Similarly, if the golfer 10 has determined that their putter selection zone from the golf putter fitting device 100 is 1D then the appropriate or recommended putter type for this zone and golfer 10 would be a Toe Hang of 6 degrees as shown in table 200. The putter selection table 200 is used a reference guide to match the putter's toe hang to an individual's stroke type based on their dominant eye position within the zones. Moreover, the degree by which the zones shown in the putter selection table 200 may be dependent upon the skill level of the golfer.

Figure 12:
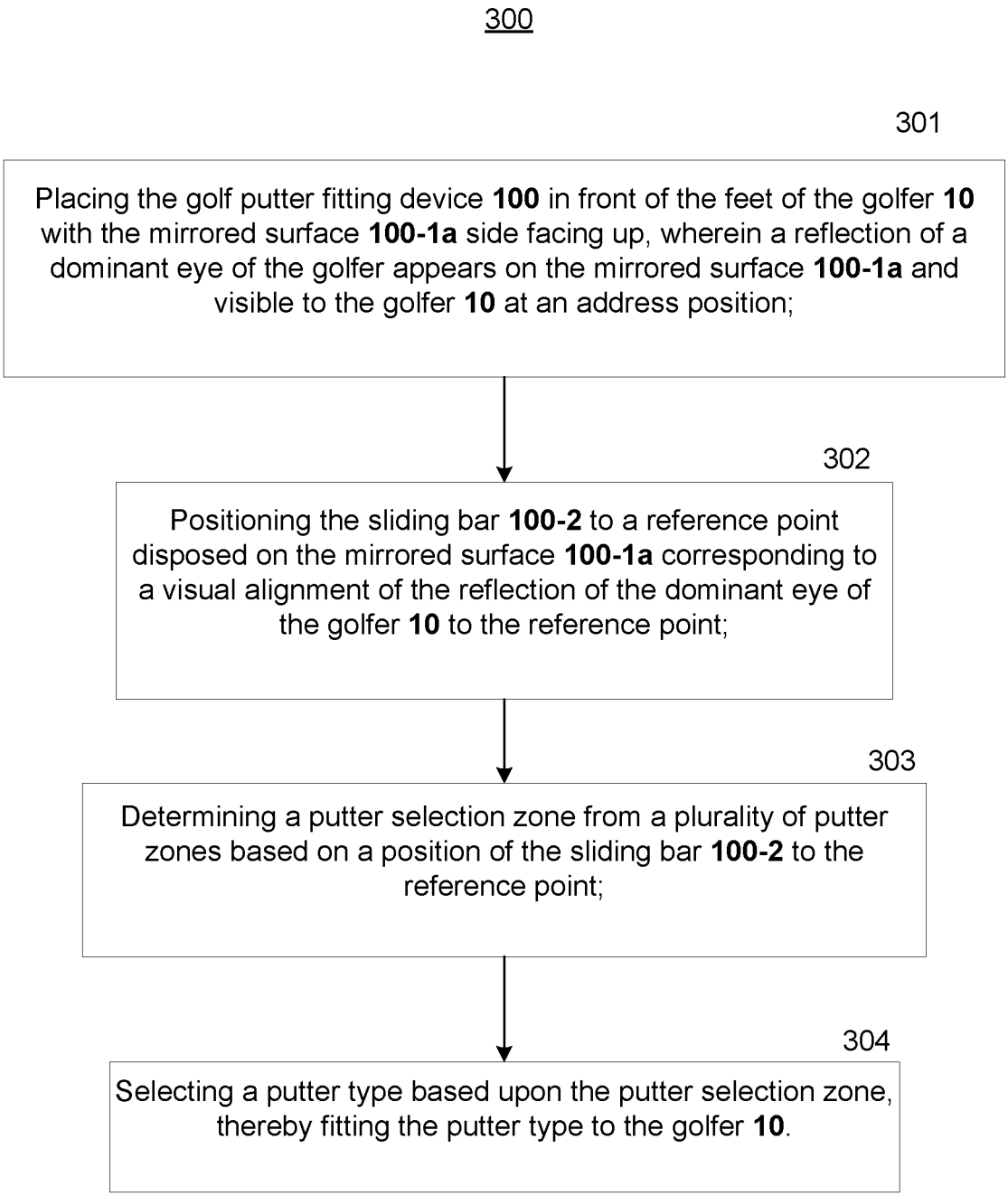
FIG. 12 illustrates a putter fitting method of fitting a putter type to a golfer using the golf putter fitting device, in accordance to an embodiment.

FIG. 12 illustrates a putter fitting method 300 of selecting a putter type for a golfer 10 using the golf putter fitting device 100, in accordance to an embodiment. The steps of the putter fitting method 300 including:

1) Placing the golf putter fitting device 100 in front of the feet of the golfer 10 with the mirrored surface 100-1*a* side facing up, wherein a reflection of a dominant eye of the golfer appears on the mirrored surface 100-1*a* and visible to the golfer 10 at an address position; (Step 301)
2) Positioning the sliding bar 100-2 to a reference point disposed on the mirrored surface 100-1*a* corresponding to a visual alignment of the reflection of the dominant eye of the golfer 10 to the reference point; (Step 302)
3) Determining a putter selection zone from a plurality of putter zones (Zone 1, Zone 2, Zone 3) based on a position of the sliding bar 100-2 to the reference point; (Step 303)
4) Selecting a putter type based upon the putter selection zone, thereby fitting the putter type to the golfer 10. (Step 304)

Figure 13B:
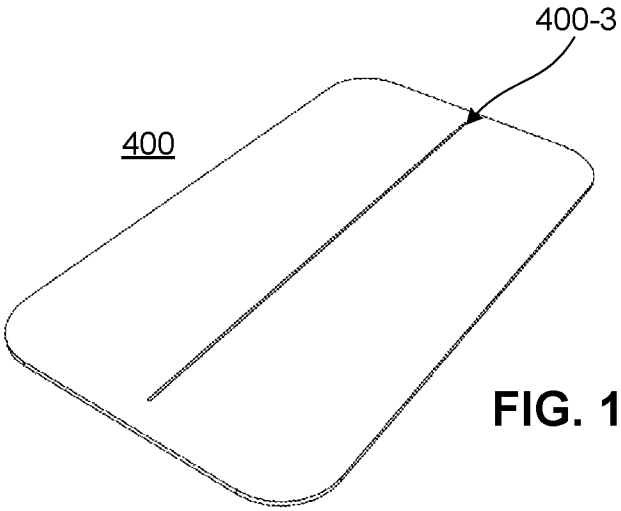
FIG. 13A-FIG. 13C illustrates an alignment pad that may be coupled to the golf putter fitting device, in accordance to an embodiment.
Figure 13A:
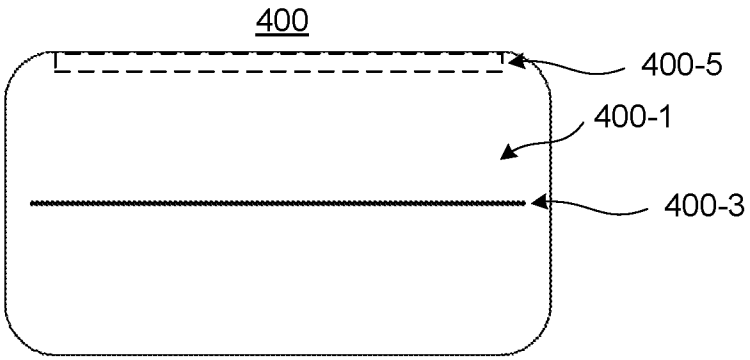
Figure 13C:
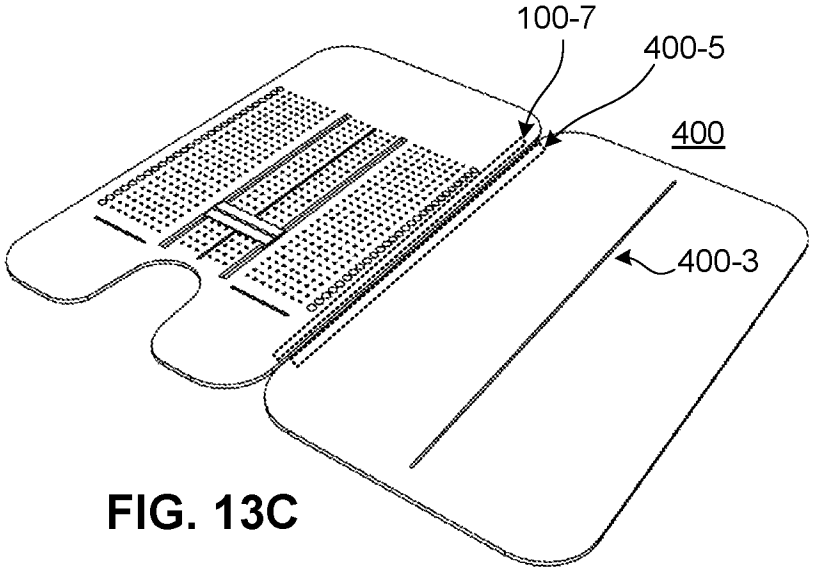

FIG. 13A-FIG. 13C illustrates an alignment pad 400 that may be coupled to the golf putter fitting device 100, in accordance to an embodiment. The alignment pad 400 may be identical in shape and size to the golf putter fitting device 100 and include a reflecting surface 400-1 disposed on a top portion of the alignment pad 400, a horizontal reference line 400-3 centrally disposed along a lengthwise portion of the reflecting surface 400-1, and magnetic member 400-5 embedded or coupled along an edge portion of the alignment pad 400, allowing the alignment pad 400 to magnetically couple to the golf putter fitting device 100 along magnetic members (100-7 and 400-5). In practice, the alignment pad 400 is a visual alignment tool for the golfer 10, allowing them to see a reflection of their shoulder and arm in the reflecting surface 400-1 relative to the horizontal reference line 400-3 and align their torso so that it square to the golf putter fitting device 100 for putter type and fitting purposes. The horizontal reference line 400-3 may include any shape including but not limited to lines, dashed lines, dots, shades, gradients, graphics, and/or texts of any color.

Figure 14:
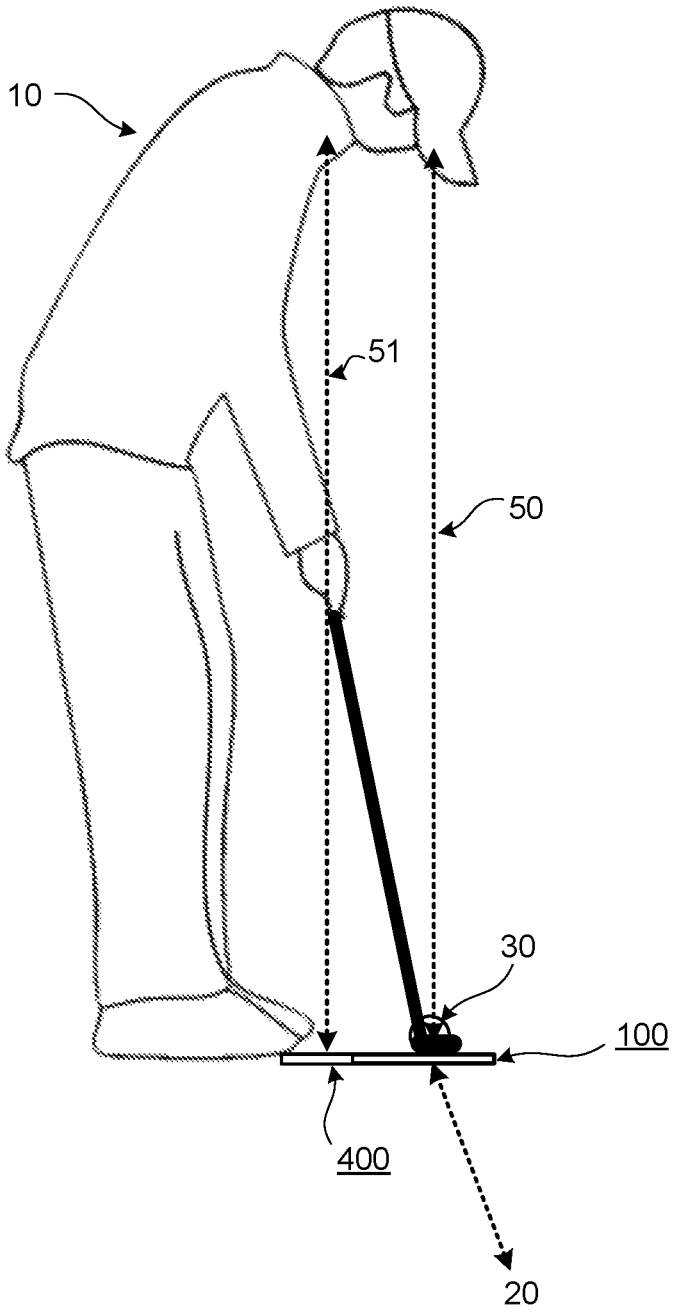
FIG. 14 illustrates an application of the golf putter fitting device and the alignment pad as putter alignment training devices, in accordance to an embodiment.

FIG. 14 illustrates an application of the golf putter fitting device 100 and the alignment pad 400 as putter alignment training devices, in accordance to an embodiment. As training aid devices, the golf putter fitting device 100 and the alignment pad 400 can be applied directly onto the golf playing field allowing the golfer 10 to align their shoulders and arms to the target line 20 with golf ball 30 on the target line by using the horizontal target line 100-5*a* from the golf putter fitting device 100 and the horizontal reference line 400-3 from the alignment pad 400 as lines of references relative to their eye reflection 50 and shoulder alignment reflection 51 on the golf putter fitting device 100 and the alignment pad 400, respectively.

In sum, the golf putter fitting device 100 is an easy, precise, and convenient tool and method for quickly fitting a putter type to a golfer. Other benefits include: 1) a compact, flat, lightweight, and impact-resistant design; 2) multi-use features such as a putter fitting device and golf training device; 3) a non-slip backside surface for preventing the device 100 to move or slip while in use; 4) minimal components including only a pad and sliding assembly; and 5) proprietary reference markers specifically designed to match a dominant eye to a putter zone for putter type selection.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present disclosure. Although the present disclosure has been shown and described with respect to several preferred embodiments thereof, various changes, omissions, and additions to the form and detail thereof, may be made therein, without departing from the spirit and scope of the disclosure. It is understood that the words which have been used herein are words of description and illustration, rather than words of limitation. Changes may be made, within the purview of the appended claims, as presently stated and as amended, without departing from the scope and spirit of the present disclosure in its aspects.

Other embodiments and modifications of the present disclosure may occur to those of ordinary skill in the art in view of these teachings. Accordingly, the disclosure is to be limited only by the following claims which include all other such embodiments and modifications when viewed in conjunction with the above specifications and accompanying drawings.

What is claimed is:

1. A golf putter fitting device for selecting a golf putter type for a golfer comprising:

a thin pad having a mirrored surface disposed on a top side portion of the thin pad and two slots disposed along a lengthwise section of the thin pad;

a sliding bar disposed on the mirrored surface and slidably coupled to the two slots; and a plurality of reference markers disposed on the mirrored surface for determining a putter selection zone from a plurality of putter zones by sliding the sliding bar to a reference point disposed on the mirrored surface corresponding to a visual alignment of a reflection of a dominant eye of the golfer to the reference point when the golf putter fitting device is placed on a ground surface with the mirrored surface facing the golfer at an address position and directly viewed from above by the golfer and a face portion of the golfer is reflected on the mirrored surface, wherein the golf putter type is selected based upon the putter selection zone and the dominant eye of the golfer.

2. The golf putter fitting device of claim 1, wherein a ball slot is disposed along an edge portion of the thin pad.

3. The golf putter fitting device of claim 2, wherein the plurality of reference markers a horizontal target line centrally disposed along the lengthwise section of the thin pad, two vertical putter lines disposed proximate to the golf ball slot, a first array of dots disposed on one side of the horizontal putter line, and a second array of dots matching the first array of dots, wherein the horizontal target line separates the first array of dots from the second array of dots, a first horizontal row of dots adjacent to the first array of dots, and a second horizontal row of dots adjacent to the second array of dots.

4. The golf putter fitting device of claim 3, wherein the first array of dots, second array of dots, first horizontal row of dots, and second horizontal row of dots are separated into groups of three equally divided columns representing the plurality of putter zones.

5. The golf putter fitting device of claim 1, wherein a slip resistance surface is applied to a bottom side of the thin pad.

6. The golf putter fitting device of claim 1, wherein the dominant eye of the golfer is a left eye or a right eye of the golfer.

7. The golf putter fitting device of claim 1, wherein the golf putter type includes a face balanced putter, a slight toe hang putter, a moderate toe hang putter, or a high toe hang putter.

8. The golf putter fitting device of claim 1, wherein an alignment pad is magnetically coupled to the golf putter fitting device via magnetic members disposed along an edge portion of the alignment pad and an edge portion of the golf putter fitting device.

9. The golf putter fitting device of claim 8, wherein the alignment pad includes a reflecting surface disposed on a top portion of the alignment pad and a horizontal reference line disposed on the reflecting surface.

10. The golf putter fitting device of claim 8, wherein the golf putter fitting device and the alignment pad act as visual alignment training aids, allowing the golfer to view and align a reflected image of shoulders and arms of the golfer to a horizontal target line disposed on the golf putter fitting device and a horizontal reference line disposed on the alignment pad.

11. A method of selecting a putter type for a golfer via a golf putter fitting device having a thin pad, a mirrored surface disposed on a top side portion of the thin pad, two slots disposed along a lengthwise section of the thin pad, a sliding bar disposed on the mirrored surface and slidably coupled to the two slots, and a plurality of reference markers disposed on the mirrored surface, the method comprising:

placing the golf putter fitting device in front of the feet of the golfer with the mirrored surface facing up, wherein a reflection of a dominant eye of the golfer appears on the mirrored surface and visible to the golfer at an address position;

positioning the sliding bar to a reference point disposed on the mirrored surface corresponding to a visual alignment of the reflection of the dominant eye of the golfer to the reference point;

determining a putter selection zone from a plurality of putter zones based on a position of the sliding bar to the reference point; and selecting a putter type based upon the putter selection zone.

12. The method of claim 11, wherein a ball slot is disposed along an edge portion of the thin pad.

13. The method of claim 12, wherein the plurality of reference markers a horizontal target line centrally disposed along the lengthwise section of the thin pad, two vertical putter lines disposed proximate to the golf ball slot, a first array of dots disposed on one side of the horizontal putter line, and a second array of dots matching the first array of dots, wherein the horizontal target line separates the first array of dots from the second array of dots, a first horizontal row of dots adjacent to the first array of dots, and a second horizontal row of dots adjacent to the second array of dots.

14. The method of claim 13, wherein the first array of dots, second array of dots, first horizontal row of dots, and second horizontal row of dots are separated into groups of three equally divided columns representing the plurality of putter zones.

15. The method of claim 11, wherein a slip resistance surface is applied to a bottom side of the thin pad.

16. The method of claim 11, wherein the dominant eye of the golfer is a left eye or a right eye of the golfer.

17. The method of claim 11, wherein the golf putter type includes a face balanced putter, a slight toe hang putter, a moderate toe hang putter, or a high toe hang putter.

18. The method of claim 11, wherein an alignment pad is magnetically coupled to the golf putter fitting device via magnetic members disposed along an edge portion of the alignment pad and an edge portion of the golf putter fitting device.

19. The method of claim 18, wherein the alignment pad includes a reflecting surface disposed on a top portion of the alignment pad and a horizontal reference line disposed on the reflecting surface.

20. The method of claim 18, wherein the golf putter fitting device and the alignment pad act as visual alignment training aids, allowing the golfer to view and align a reflected image of shoulders and arms of the golfer to a horizontal target line disposed on the golf putter fitting device and a horizontal reference line disposed on the alignment pad.

* * * * *